United States Patent [19]

Lu

[11] 4,293,631

[45] Oct. 6, 1981

[54] ELECTROGRAPHIC TONER COMPOSITIONS

[75] Inventor: Chin H. Lu, Webster, N.Y.

[73] Assignee: Xerox Corporation, Stamford, Conn.

[21] Appl. No.: 19,694

[22] Filed: Mar. 12, 1979

[51] Int. Cl.[3] ..... G03G 9/10

[52] U.S. Cl. ..... 430/106; 430/108; 430/109; 430/110; 430/904

[58] Field of Search ..... 430/110, 115, 100, 106, 430/108, 109; 260/DIG. 20, 404.5 Q; 252/500

[56] References Cited

U.S. PATENT DOCUMENTS

| | | | |
|---|---|---|---|
| 2,589,674 | 3/1952 | Cook et al. | 260/404.5 Q |
| 3,844,966 | 10/1974 | Nelson | 252/62.1 |
| 3,859,378 | 1/1975 | Hochreuter | 260/404.5 Q |
| 3,944,493 | 3/1976 | Jadwin | 252/62.1 P |
| 3,970,571 | 7/1976 | Olson | 430/110 X |
| 3,985,664 | 10/1976 | Sakaguchi et al. | 252/621 |

FOREIGN PATENT DOCUMENTS 1174573 12/1969 United Kingdom .

*Primary Examiner*—John D. Welsh
*Attorney, Agent, or Firm*—E. O. Palazzo

[57] ABSTRACT

Disclosed are positively charged toner compositions comprised of a thermoplastic resin, a pigment or colorant, and a charge inducing additive containing an amido dialkyl hydroxy ammonium compound of the formula:

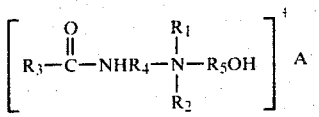

wherein $R_1$, $R_2$ and $R_3$ are independently selected from hydrocarbon radicals containing up to 22 carbon atoms; and more specifically $R_1$ and $R_2$ are hydrocarbon radicals containing from 1 carbon atom to about 8 carbon atoms, $R_3$ is a hydrocarbon radical containing from about 8 carbon atoms to about 22 carbon atoms; $R_4$ and $R_5$ are independently selected from alkylene radicals having up to 8 carbon atoms, and preferably from 1 carbon atom to about 5 carbon atoms; and A is an anion such as nitrate, dihydrogen phosphate, methyl hydrogen phosphate, and dimethyl phosphate. Developers containing these positively charged toner materials are prepared by adding carrier materials thereto. These developers can then be employed in an electrophotographic imaging system particularly those systems using organic photoreceptors such as polyvinylcarbazole which are charged negatively.

1 Claim, No Drawings

ELECTROGRAPHIC TONER COMPOSITIONS

This invention is generally directed to new toners, developers containing these new toners, and the use of such developers for causing the development of images in an electrophotographic system. More specifically the present invention is directed to toners and developers containing such toners, these toners containing certain charge inducing agents primarily for the purpose of providing positive charge for the toner material.

The electrophotographic process and more specifically the xerographic process is well known as documented in numerous prior art references including many patents, this process generally involving the uniform charging of a photoconductive insulating surface which is conductive under the influence of a light image thus allowing electrostatic charge formed thereon to be selectively dissipated in order to produce a latent image which is developed by means of a variety of pigmented resin materials specifically made for this purpose such as toners. These toner materials are electrostatically attracted to the latent image areas on the plate in proportion to the charge concentration contained thereon. Many processes are known for applying the toner or electroscopic particles to the electrostatic latent image to be developed such as for example the development method described in U.S. Pat. No. 3,618,552 cascade development, U.S. Pat. Nos. 2,874,063; 3,251,706; and 3,357,402, magnetic brush development, U.S. Pat. No. 2,221,776, powder cloud development and U.S. Pat. No. 3,166,432, touchdown development.

It may be desirable in some instances in electrophotographic systems and particularly xerographic systems to produce a reverse copy of the original. For example, it may be desired to produce a negative copy from a positive original or a positive copy from a negative original. This is generally referred to in the art as image reversal and in electrostatic printing such image reversal can be effected by applying to the image a developer powder which is repelled by the charged areas of the image and adheres to the discharge areas. Specifically toners possessing positive charges are found to be very useful and effective in electrophotographic reversal systems and in particular in electrophotographic systems employing organic photoreceptors which in many instances are initially charged negatively rather than positively thus necessitating the need for a positively charged toner. It is important to note that in a dual development system, that is where carrier and toner are both being employed that the toner charges positively in comparison to the charge on the carrier which is charged negatively. Most commercial machines use negatively charged toner; thus when the toner and carrier are mixed the toner acquires a negative charge and the carrier a positive charge in relationship to one another, this concept being referred to as the triboelectric relationship of the materials employed.

Reversal developers are described in U.S. Pat. No. 2,986,521, these developers being comprised of electroscopic material coated with finely divided colloidal silica. This material when used in an electrostatic development system results in the development of electrostatic images on negatively charged surfaces which development is accomplished by applying the electroscopic material having a positive triboelectric relationship with respect to the colloidal silica.

In U.S. Pat. No. 3,893,935, there is described the use of certain quarternary ammonium salts as charge control agents for electrostatic toner compositions. This patent states that certain quaternary ammonium salts when incorporated into toner materials were found to provide a particulate toner composition which exhibited relatively high uniform and stable toner charge when mixed with a suitable carrier vehicle; and which toner further also exhibited a minimum amount of toner throw-off. U.S. Pat. No. 4,079,014 contains a similar teaching with the exception that a different charge control agent is used, namely a diazyl type compound. British Pat. No. 1,501,065 is also of interest in that it discloses the use of certain quaternary ammonium compounds which can be used as charge control agents.

Many of the above-described developers have a tendency to lose their positive charge over a long period of time, are difficult to prepare and therefore the quality of the images to be developed is adversely affected over a long period of time. Further, the use of charge control agents and developers as described in U.S. Pat. No. 3,893,935 are soluble in water causing them to be leached into the toner surface by moisture thereby adversely affecting the machine environment, the copy quality and further such toners containing these materials are humidity sensitive. Additionally these materials are incompatible with the thermoplastic resins used in toners and it is very difficult to uniformly disperse or dissolve such materials in the toner. This causes particle to particle nonuniformity and wide distribution of electrical charge which reduces the quality of the image developed and shortens the developer life.

Accordingly, there is a need for developer which can be used in a reverse development system and specifically the need for a positively charged toner which when used in systems requiring such toners allows the production of high quality images over a long period of time and which toners have excellent thermal stability.

SUMMARY OF THE INVENTION

It is an object of this invention to provide a toner which overcomes the above-noted disadvantages.

It is a further object of this invention to provide a developer which contains toner and carrier with the toner being charged positively.

Another object of this invention is the provision of a thermally stable developer which contains positively charged toner resins.

An additional object of this invention is to provide toners which will develop electrostatic images containing negative charges on the photoreceptor surface and which will transfer effectively electrostatically from such a photoreceptor to plain bond paper without causing blurring or adversely affecting the quality of the resulting images.

Yet another object of this invention is to provide charge inducing material which are completely compatible with the toner resin.

A further object of the present invention is the provision of developers containing toners which have improved particle to particle uniformity and narrow charge distribution.

Another object of this invention is the provision of developers which have rapidly fast charging rates, excellent admix charge behavior, and narrow charge distribution.

These and other objects of the present invention are accomplished by providing toner compositions comprised of a thermoplastic resin, a pigment or colorant, and a amido dialkyl hydroxy ammonium compound of the following formula:

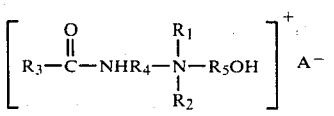

wherein $R_1$, $R_2$, and $R_3$ are independently selected from hydrocarbon radicals containing up to 22 carbon atoms, and specifically $R_1$ and $R_2$ are hydrocarbon radicals containing from 1 carbon atom to about 8 carbon atoms; $R_3$ is a hydrocarbon radical containing from about 8 carbon atoms to about 22 carbon atoms; $R_4$ and $R_5$ are independently selected from alkylene radicals having up to 8 carbon atoms, and preferably from 1 carbon atom to about 5 carbon atoms; and A is an anion such as nitrate, dihydrogen phosphate, methyl hydrogen phosphate, and dimethyl phosphate.

Illustrative examples of the $R_1$, $R_2$, and $R_3$ hydrocarbon radicals include for example methyl, ethyl, propyl, butyl, isobutyl, pentyl, hexyl, heptyl, octyl, nonyl, decayl, lauryl, myristyl, cetyl, oleoyl, pentadecyl, heptadecyl, and octadecyl. Examples of alkylene radicals include methylene, ethylene, propylene, butylene, penylene, hexylene, heptylene, and octylene. These R radicals can be substituted by alkyl, as defined hereinbefore and aromatic groups such as phenyl, benzyl, napthyl, and the like.

Illustrative examples of amido dialkyl hydroxy ammonium compounds useful in the present invention include for example stearamidopropyl dimethyl-beta-hydroxyethyl ammonium dihydrogen phosphate, stearamidopropyl dimethyl-beta-hydroxyethyl ammonium nitrate, lauramidopropyl methyl benzyl beta-hydroxyethyl ammonium dihydrogen phosphate, and the like. Other compounds not specifically listed herein may also be useful and this listing is not intended to limit the scope of the present invention.

The amount of amido dialkyl hydroxy ammonium compound used can vary over wide ranges but generally any amount that results in a toner that is charged positively in comparison to the carrier and that develops and electrostatically transfers well is envisioned. For example, the amount of amido dialkyl hydroxy ammonium compound present ranges from about 0.1 weight percent to 10 weight percent and preferably 0.5 weight percent to 5 weight percent of the total toner weight. The amido dialkyl hydroxy ammonium compound can be blended into the system coated on the pigment or colorant such as carbon black, or both that is blended into the system and coated on the pigment, when used for example in developing compositions. When coated the amido compound is present in about 1 percent to 6 percent by weight of pigment, and preferably from about 2 percent to about 4 percent by weight of pigment.

The toner of the present invention is generally employed together with a carrier, these two materials in combination being referred to as the developer composition. In this developer composition the toner becomes positively charged in view of the presence of the amido dialkyl hydroxy ammonium compounds with the carrier being charged negatively. Futher details as to the sizes and proportions of carrier materials are described hereinafter.

Several different numerous methods can be utilized to produce the toner of the present invention, one such method involving melt blending the resin, the pigment, and the dialkylamido hydroxy ammonium compound followed by mechanical attrition. Other methods include those well known in the art such as spray drying, melt dispersion and dispersion polymerization. For example, a solvent dispersion of resin, pigment and amido dialkyl hydroxy ammonium compound are spray dried under controlled conditions, thereby resulting in the desired product. A material prepared in this manner results in a positive charged toner when used together with a carrier, and such toners exhibit improved properties as mentioned herein.

Any suitable thermoplastic resin may be employed as part of the toner composition of the present invention; typical resins including for example polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene vinyl napthalene, ethylenecally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenol-formaldehyde resins, oil modified epoxy resins, polyurethane resins, cellulosic resins, polyether resins and mixtures thereof.

Also esterification products of a dicarboxylic acid and a diol comprising a diphenol may be used as a preferred resin material for the toner composition of the present invention. These materials are illustrated in U.S. Pat. No. 3,655,374 totally incorporated herein by reference, the diphenol reactant being of the formula as shown in Column 4 beginning at line 5 of this patent and the dicarboxylic acid being of the formula as shown in Column 6 of the above patent. The resin is present in an amount so that the total of all ingredients used in the toner total about 100 percent, thus when 5 percent by weight of the amido dialkyl hydroxy ammonium compound is used and 10 percent by weight of the pigment such as carbon black, about 85 percent by weight of resin material is used.

Optimum electrophotographic resins are achieved with styrene butylmethacrylate copolymers, styrene vinyl toluene copolymers, styrene acrylate copolymers, polyester resins, predominantly styrene or polystyrene base resins as generally described in U.S. Pat. No. Re. 25,136 to Carlson and polystyrene blends as described in U.S. Pat. No. 2,788,288 to Rheinfrank and Jones.

The toners used in the present invention can as previously disclosed be prepared by various known methods, such as spray drying. In the spray drying method the appropriate polymer is dissolved in an organic solvent like dichloromethane. The toner colorant and amido dialkyl hydroxy ammonium compound are also added to the solvent. This solution is then sprayed through an atomizing nozzle using an inert gas such as nitrogen, as the atomizing agent. The solvent evaporates during atomization, resulting in toner particles of a pigmented resin. Particle size of the resulting resin varies depending on the size of the nozzle, however particles of a diameter between about 0.1 micrometers and about 100 micrometers generally are obtained. Melt blending processes can also be used for preparing the toner compositions of the present invention. This involves melting a powdered form of an appropriate polymeric resin and mixing it with suitable colorants such as pigments, and the amido dialkyl hydroxy ammonium compound of the present invention. The resin can be melted by heated rolls, which rollers can be used to stir, and blend the resin. After thorough blending the mixture is cooled and solidified. The solid mass that results is broken into small pieces and subsequently finely ground so as to form free flowing toner particles, which range in size of from 0.1 to about 100–200 microns.

Any suitable pigment or dye may be employed as the colorant for the toner particles, such materials being known and including for example, carbon black, magnetite, nigrosine dye, aniline blue, calco oil blue, chrome yellow, ultramarine blue, DuPont oil red, methylene blue chloride, phthalocyanine blue and mixtures thereof. The pigment or dye should be present in the toner and in sufficient quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products Inc. Preferably the pigment is employed in amounts from about 3 percent to about 20 percent by weight based on the total weight of toner, however, if the toner colorant employed is a dye, substantially smaller quantities of the colorant may be used. When magnetite is employed as the colorant, approximately 20 weight percent of 70 weight percent of the total weight of toner is used. Other pigments that may be useful include for example, Gilsonite, Prussian Blue, various iron oxides, and the like.

Any suitable carrier material can be employed as long as such particles are capable of triboelectrically obtaining a charge of opposite polarity to that of the toner particles. In the present invention in one embodiment that would be a negative polarity, to that of the toner particles which are positively charged so that the toner particles will adhere to and surround the carrier particles. Thus the carriers can be selected so that the toner particles acquire a charge of a positive polarity and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like. The carriers can be used with or without a coating. Many of the typical carriers that can be used are described in U.S. Pat. Nos. 2,618,441; 2,638,416; 2,618,522; 3,591,503; 3,533,835; and 3,526,533. Also nickel berry carriers as described in U.S. Pat. Nos. 3,847,604 and 3,767,598 can be employed, these carriers being modular carrier beads of nickel characterized by surface of reoccurring recesses and protrusions providing particles with a relatively large external area, coated carrier particles including materials coated with various fluorocarbons such as polytetrafluoroethylene, polyvinylidene fluoride, mixtures thereof, and the like. The diameter of the coated carrier particle is from about 50 to about 1000 microns, thus allowing the carrier to possess sufficient density and inertia to avoid adherence to the electrostatic images during the development process. Also useful are other magnetic carrier particles such as iron, cobalt, nickel, porous iron particles having oxidized surfaces and the like.

The carrier may be employed with the toner composition in any suitable combination, however, best results are obtained when about 1 part per toner is used and about 10 to about 200 parts by weight of carrier.

Toner compositions of the present invention may be used to develop electrostatic latent images on any suitable electrostatic surface capable of retaining charge including conventional photoconductors, however, the toners of the present invention are best utilized in systems wherein a negative charge resides on the photoreceptor and this usually occurs with organic photoreceptors, illustrative examples of such photoreceptors being polyvinyl carbazole, 4-dimethylamino benzylidene, benzhydrazide; 2-benzylideneamino-carbazole, 4-dimethylamino-benzylidene, benzhydrazide; 2-benzylideneamino-carbazole, polyvinyl carbazole; (2-nitrobenzylidene)-p-bromoaniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazoletritrofluorenone charge transfer comples; phthalocyanines and mixtures thereof.

The following examples are being supplied to further define the species of the present invention, it being noted that these examples are intended to illustrate and not limit the scope of the present invention. Parts and percentages are by weight unless otherwise indicated.

EXAMPLE I

Toner A was prepared comprising 6 percent Regal 330 carbon black commercially available from Cabot Corporation, 2 percent of stearamidopropyl dimethyl beta-hydroxyethyl ammonium dihydrogen phosphate of the following structure:

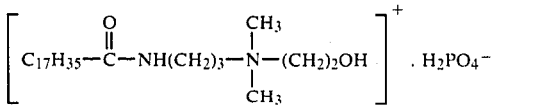

and 92 percent of a 65/35 styrene/n-butyl methacrylate copolymer resin, by melt blending followed by mechanical attrition. Three parts per weight of this toner and 100 parts of 0.15 percent polyvinylidene fluoride coated on a Hoeganaes steel carrier were placed in a glass jar and roll mixed at a linear speed of 90 feet per minute for the time indicated in the following table. The triboelectric charge of the toner was measured by blowing off the toner from the carrier in a Faraday cage.

| Roll Mixing Time | Ioner Tribo μc/g (Microcoulombs/Gram) |
|---|---|
| 1 minute | +29 |
| 10 minutes | +33 |
| 1 hour | +31 |
| 4 hours | +29 |

The toner of this example, toner A, was classified to remove particles having a diameter of less than 5 microns. Three parts of the classified toner were mixed with 100 parts of the above mentioned carrier and tested in an electrophotographic device for print quality, this device containing a photoreceptor charged negatively. Good quality prints with high optical density and low background were obtained. The carbon black dispersion and particle to particle uniformity of this toner were examined by transmission electron microscope techniques and from this examination excellent results were shown in both categories. Admix experiments indicated the developer had very fast charging characteristics and very narrow charge distribution.

EXAMPLE II

Toner B comprising 6 percent Regal 330 carbon black commercially available from Cabot Corporation, 2 percent of stearamidopropyl dimethyl beta-hydroxyethyl ammonium nitrate of the following structure:

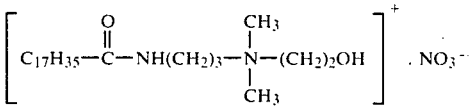

and 92 percent of a 65/35 styrene/n-butyl methacrylate copolymer resin was prepared by melt blending followed by mechanical attrition. This toner was placed in a glass jar together with the Hoeganaes steel carrier, per Example I. Triboelectric measurements were made in accordance with Example I, that is by blowing off the toner from the carrier in a Faraday cage.

| Roll Mixing Time | Toner Tribo μc/g (Microcoulombs/Gram) |
|---|---|
| 1 minute | +29 |
| 10 minutes | +34 |
| 1 hour | +26 |
| 4 hours | +19 |

The toner was classified to remove particles having a diameter of less than 5 microns and the developer toner plus the carrier of Example I was tested in a device using a photoreceptor charged negatively. Good quality prints with high optical density and low background were obtained. Also the carbon black dispersion and particle to particle uniformity of this toner were examined by transmission electron microscope techniques and from this examination excellent results were shown in both categories. Admix experiments indicated the developer had very fast charging characteristics and very narrow charge distribution.

EXAMPLE III

Toner C comprising 10 percent Raven 420 carbon black commercially available from Cities Service Co. treated with 4.0% of stearamidopropyl dimethyl-beta-hydroxyethyl ammonium nitrate based on the weight of the pigment and 90 percent polystyrene resin was prepared by melt blending followed by mechanical attrition. This toner was placed in a glass jar together with a steel carrier coated with 0.25 percent polyvinylidene fluoride. Substantially similar triboelectric values, and substantially similar results were obtained as in Example I.

EXAMPLE IV

Toner D comprising 25 percent Mapico black magnetite, 3 percent stearamidopropyl dimethyl-beta-hydroxyethyl ammonium dihydrogen phosphate, 72 percent epoxy resin was prepared by melt blending followed by mechanical attrition. This toner was placed in a glass jar together with a steel carrier coated with 0.25 percent polyvinylidene fluoride. Substantially similar triboelectric values and substantially similar results were obtained as in Example I. Also the pigment dispersion and particle to particle uniformity of this toner were examined by transmission electron microscope techniques and from this examination excellent results were shown in both categories. Admix experiments indicated the developer had very fast charging characteristics and very narrow charge distribution.

Other modifications of the present invention will occur to those skilled in the art upon a reading of the present disclosure. These are intended to be included within the scope of this invention.

What we claim is:

1. A developer composition comprised of a resin component, a carrier component, a colorant, and a charge inducing material wherein the resin is selected from the group consisting of a styrene/n-butyl methacrylate copolymer, and polystyrene, the carrier is selected from polyvinylidene fluoride coated Hoeganaes steel carrier, and vinyl fluoride resin coated steel carrier materials, the colorant is carbon black and the charge inducing material is stearamidopropyl dimethyl beta-hydroxyethyl ammonium dihydrogen phosphate, or stearamidorpropyl dimethyl beta-hydroxyethyl ammonium nitrate, said charge including material being present in an amount of from 0.1 percent to 10 percent based on the weight of toner, wherein the toner is charged positively and the carrier is charged negatively.

* * * * *